US005228671A

United States Patent [19]

Fish et al.

[11] Patent Number: 5,228,671

[45] Date of Patent: Jul. 20, 1993

[54] SHEET FEEDER WITH SINGLE SHEET BYPASS

[75] Inventors: David J. Fish, Webster; Gregory P. Miller; Gerard R. Sturnick, both of Rochester, all of N.Y.

[73] Assignee: Xerox Corporation, Stamford, Conn.

[21] Appl. No.: 979,039

[22] Filed: Nov. 20, 1992

[51] Int. Cl.[5] ..... B65H 3/44

[52] U.S. Cl. ..... 271/9; 271/119; 271/236; 271/246

[58] Field of Search ..... 271/9, 119, 236, 245, 271/246

[56] References Cited

U.S. PATENT DOCUMENTS

| | | | |
|---|---|---|---|
| 4,203,588 | 5/1980 | Joosten | 271/246 |
| 4,337,935 | 7/1982 | Sawada et al. | 271/9 |
| 4,556,308 | 12/1985 | Hoppner et al. . | |
| 4,579,325 | 4/1986 | Pinckney et al. | 271/9 |
| 4,791,457 | 12/1988 | Shida | 271/9 |
| 4,871,160 | 10/1989 | Yoshino | 271/9 |
| 5,072,923 | 12/1991 | Coy | 271/245 |

FOREIGN PATENT DOCUMENTS

| | | | |
|---|---|---|---|
| 3608273 | 12/1986 | Fed. Rep. of Germany . | |
| 0128142 | 7/1984 | Japan . | |
| 209348 | 8/1990 | Japan | 271/245 |

*Primary Examiner*—Robert P. Olszewski
*Assistant Examiner*—Steven M. Reiss

[57] ABSTRACT

A sheet feeder with single sheet bypass sheet feeding capability has a sheet support platform for supporting a stack of sheets, at least one sheet feed roll fixedly mounted on a rotatable shaft and having a segmented feed portion for contacting and feeding the top sheet in a stack of sheets and defining therewith a sheet feeding path, sheet registration rolls downstream of the feed roll, at least one sheet bypass registration finger upstream of the registration rolls and downstream of and freely mounted about the feed roll shaft in the sheet feeding path, a sheet bypass guide rotatably mounted about the sheet registration rolls, the bypass guide having an angled sheet entrance throat to center a sheet and guide the leading edge into said bypass registration finger, the feed roll being rotatable through an opening in the bypass guide from a nonfeeding, standby position where the segmented portion is on the side of the shaft opposite the sheet support platform and a sheet feeding position where the segmented portion is between the shaft and the sheet support platform, the feed roll including a device to move the bypass registration finger out of the sheet feeding path.

16 Claims, 7 Drawing Sheets

SHEET FEEDER WITH SINGLE SHEET BYPASS

BACKGROUND OF THE INVENTION

The present invention relates to a sheet feeder and in particular to a sheet feeder having single sheet bypass capability with, for example, a sheet of a different stock from the stock present in the feed tray of the regular sheet feeder. More particularly, it's directed to such a sheet feeder for use in automatic printing machines.

In automatic printing machines there typically is at least one if not several sheet supply trays which may take the form of a fixed tray or a cassette having sheets of different sizes or weights. During operation, the sheet is fed from the single tray or fed from a tray selected on the control console of the automatic printing machine. In the routine use of such automatic printing devices, it frequently happens that the user wishes to make a print on sheet stock which is other than that in the single or plurality of sheet supplied trays. This of course may be accomplished by changing the supply of sheets in any one of the sheet supply trays in the automatic printing machine. However, to change such supply when only a small number or even one sheet of a different stock is desired is time consuming and inefficient.

Previous approaches to solving this problem have either used a cover which was placed over a print sheet supply tray or a separate tray that was pushed over the print sheet supply tray in the machine underneath the feed wheels to feed a single sheet from the separate tray on top of the stack. Alternatively, other geometries used a separate set of feed wheels to feed the bypass sheet into the sheet path.

SUMMARY OF THE INVENTION

In accordance with the present invention a simple, inexpensive reliable single sheet bypass system is provided which is adaptable to a variety of existing sheet feeders.

In accordance with a further principle aspect of the present invention a sheet feeder with a single sheet bypass feeding capability is provided comprising a sheet support platform, at least one feed roll fixedly mounted to a rotatable shaft having a segmented feed portion for contacting and feeding the top sheet in a stack of sheets, which defines a sheet feeding path, a sheet registration means downstream of the feed roll, at least one sheet bypass registration finger upstream of the registration means and downstream of and freely mounted about the feed roll shaft in the sheet feeding path, a sheet bypass guide rotatably mounted about the sheet registration means having an angled sheet entrance throat to center a sheet and guide the leading edge into the bypass registration finger, the feed roll being rotatable through an opening in the bypass guide from a nonfeeding standby position where the segmented portion is on the side of the shaft opposite the sheet support platform and a sheet feeding position where the segmented portion is between the shaft and the sheet support platform and wherein the feed roll includes means to move the bypass registration finger out of the sheet feeding path.

In a further aspect of the present invention the means to move the bypass registration finger out of the sheet feeding path includes a cam surface on the feed roll which is engagable with the bypass guide to pivot the sheet entrance throat upwardly so that at least one pin on the bypass guide is engagable with a cam surface on the bypass finger to move the bypass registration finger out of the sheet feeding path.

In a further aspect of the present invention the sheet support platform is urged upwardly toward the sheet feed roll by a normal force spring.

In a further aspect of the present invention the bypass registration finger when in the standby position rests on top of a stack of sheets when a stack of sheets is on the sheet support platform.

In a further aspect of the present invention the sheet feeder includes two corner snubbers to engage the corners of the leading edge of a stack of sheets and form a forward buckle over corner snubbers sheet feeding system.

In a further aspect of the present invention the sheet registration means includes a driven roll and an idler roll forming a stalled roll registration system.

In a further aspect of the present invention the angled sheet entrance guide has angled guide planes to both vertically and horizontally locate the leading edge of a bypass sheet.

DESCRIPTION OF PREFERRED EMBODIMENT

The invention will now be described with reference to the preferred embodiment of the sheet feeder with single sheet bypass in an electrostatographic printing apparatus.

Figure 1:
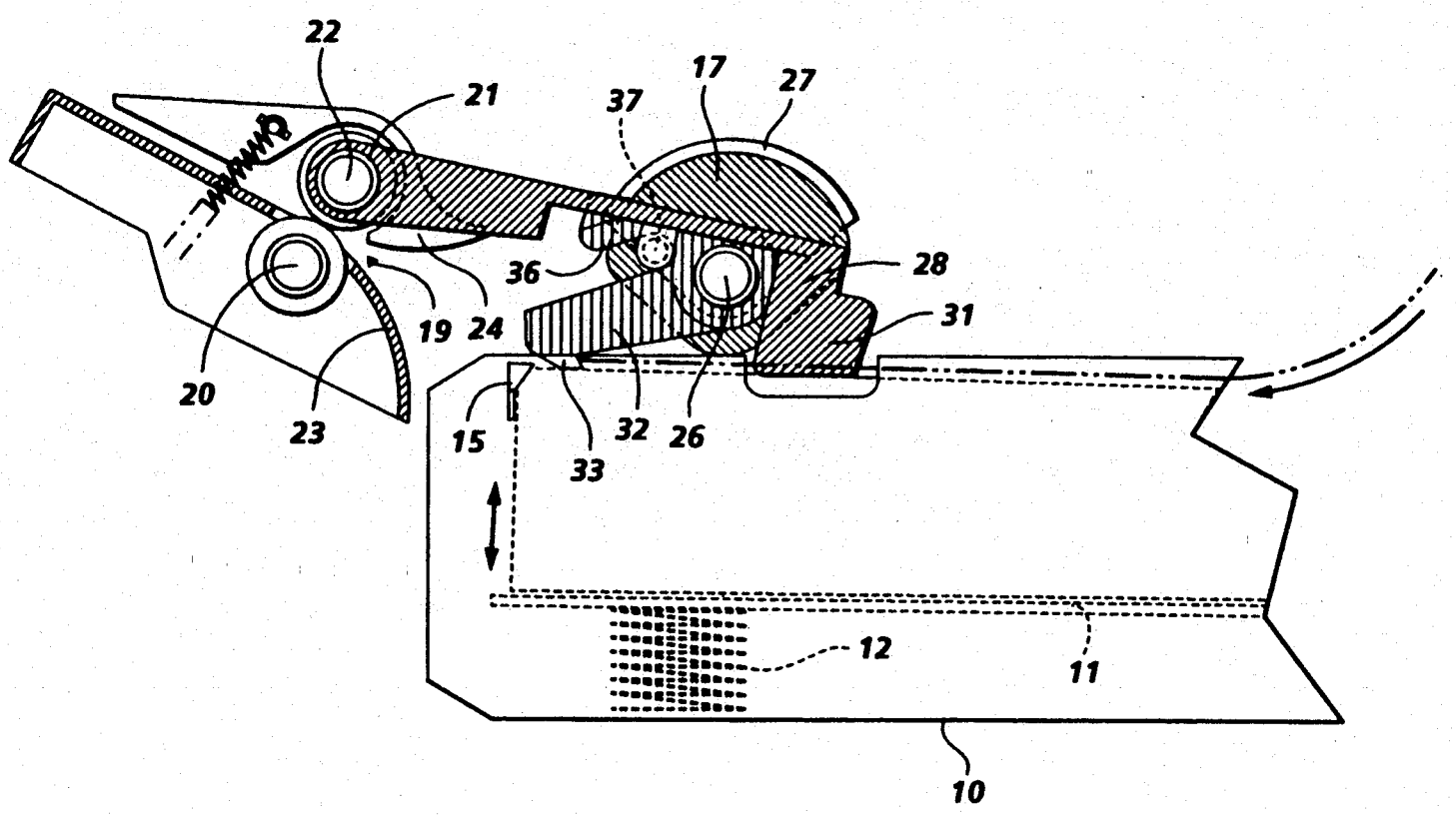
FIG. 1 is a schematic cross section of a sheet feeder with a single sheet bypass according to the present invention in the standby position.
Figure 2:
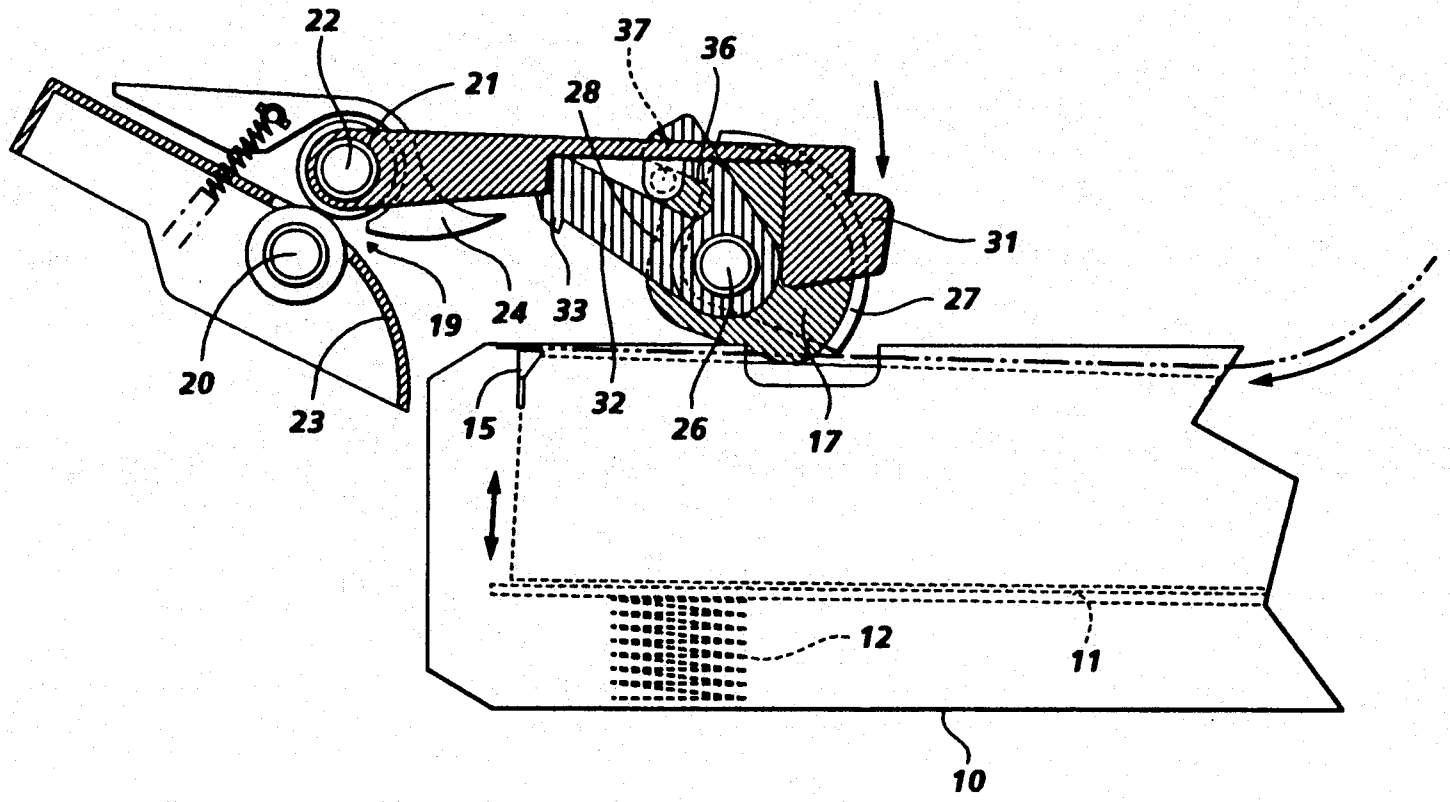
FIG. 2 is a schematic cross section of a sheet feeder with a single sheet bypass according to the present invention in the sheet feeding position.

Referring now to FIGS. 1 and 2 the sheet feeder comprises a main tray or cassette 10 having a sheet support platform 11 urged upwardly by normal force spring 12 to force the top sheet of the stack of sheets on a sheet support platform into contact with forward snubbers 15 to be in the sheet feed position. The feed roll 17 is rotated to advance the top sheet in a stack of sheets on the sheet support platform 11 in a forward direction into the sheet registration means 19 which comprises a bottom driven roll 20 and top idler roll 21, forming a registration roll pair and upper and lower guide chute members 23, 24. The registration roll pair forms a stalled rolled registration system wherein the rolls are not driven initially while a buckle is formed in the sheet to be registered and the sheet is diskewed followed by driving the lower roll and driving the registered sheet through the nip formed between the driven roll 20 and the idler roll 21.

The feed roll 17 is fixedly mounted to a rotatable shaft 26 and has a segmented feed portion 27, extending roughly through one-third of the circumference of the feed roll. The segmented feed portion has a surface having a high coefficient of friction with paper. Also mounted on the feed roll 17 and directly opposite the segmented feed portion is a cam surface 28 which is engagable with bypass guide 31 as will be described subsequently. In addition, freely mounted about the feed roll shaft 26 is at least one sheet bypass registration finger 32 which is upstream of the registration means 19 and downstream of the feed roll shaft 17, which has a sheet intercepting tip 33 to engage the leading edge of bypass sheets when they are fed into the bypass feeder. The tip 33 of the bypass finger 32 rests on the top sheet of a stack of sheets when the sheets are on a sheet stack support platform. The rotatable bypass finger has a cam surface 36 on its upper portion for engagement with at least one pin 37 located on the bypass guide 31 which will be described hereinafter. The bypass guide 31 is rotatably mounted about the shaft 22 of the top idler roll 21 of the sheet registration system 19 and forms an angled sheet entrance throat 38 for the bypass sheet that centers the sheet and guides it into the bypass registration finger 32. In particular, both sides of the bypass guide have angled guide planes 40, 41 forming a sheet entrance throat to both vertically and horizontally locate the leading edge of a bypass sheet. See FIGS. 3 and 4. The top planar portion of the bypass guide 31 also serves to provide protection of the stack of sheets from contamination by toner, developer beads, debris, etc.

Figure 3:
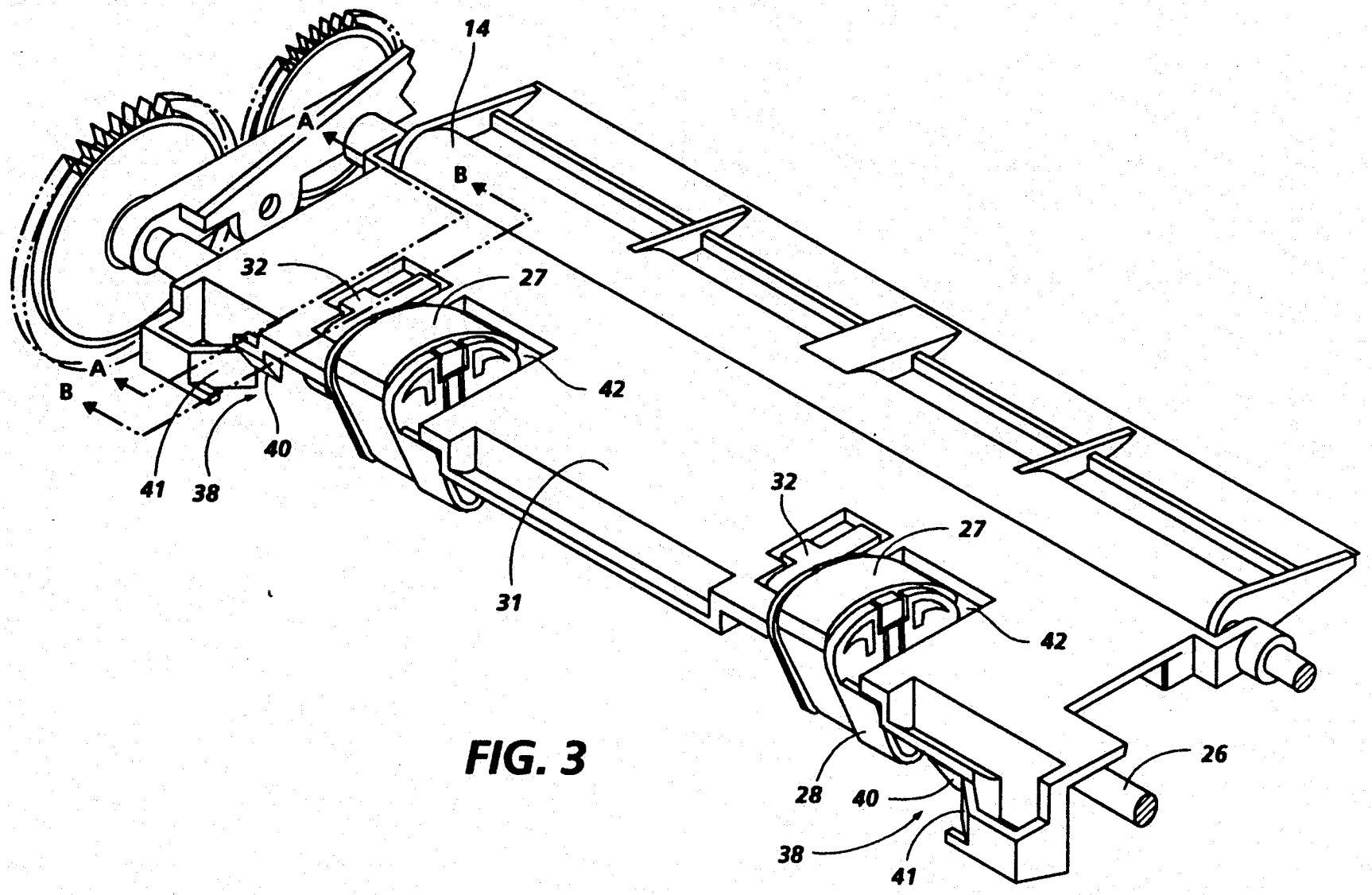
FIG. 3 is an isometric view showing the angled sheet entrance guide of the bypass feeder.
Figure 4:
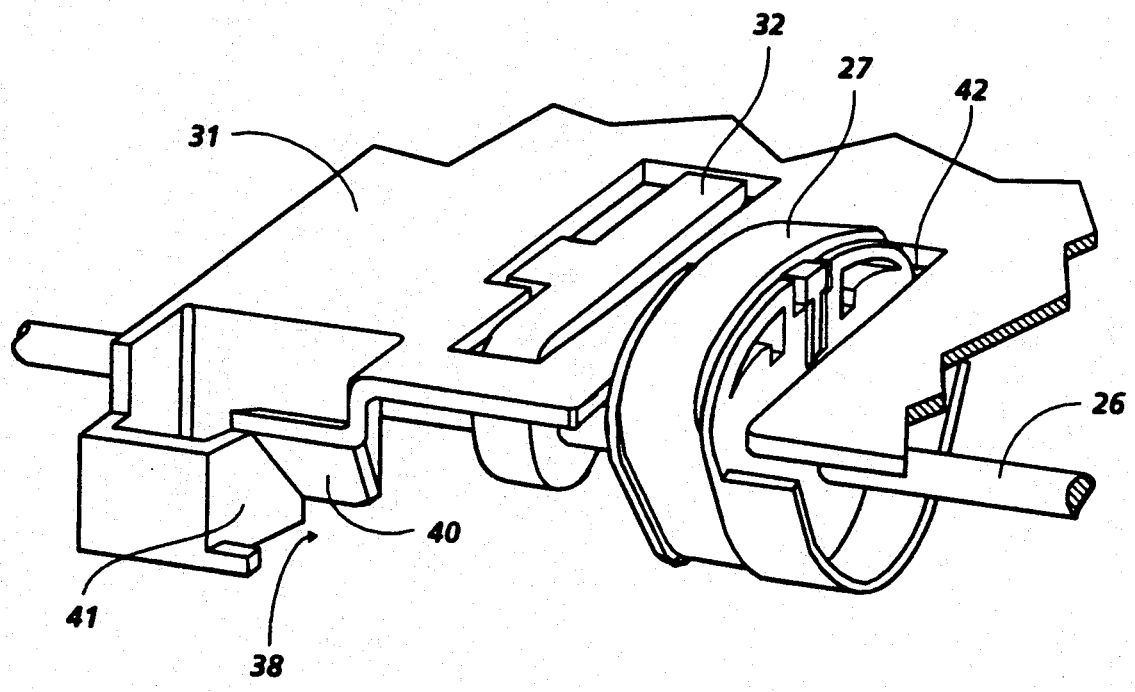
FIG. 4 is an enlarged isometric view of the angled sheet entrance guide.
Figure 5:
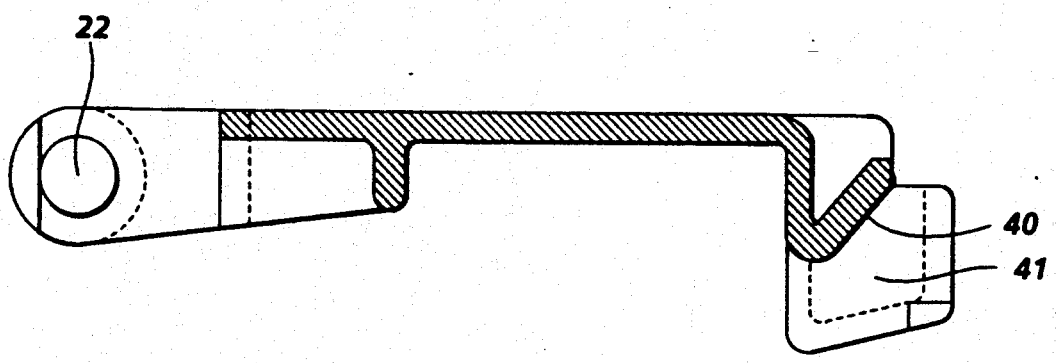
FIGS. 5 and 6 are cross sectional views of the bypass taken along the lines AA, BB respectively, guide.
Figure 6:
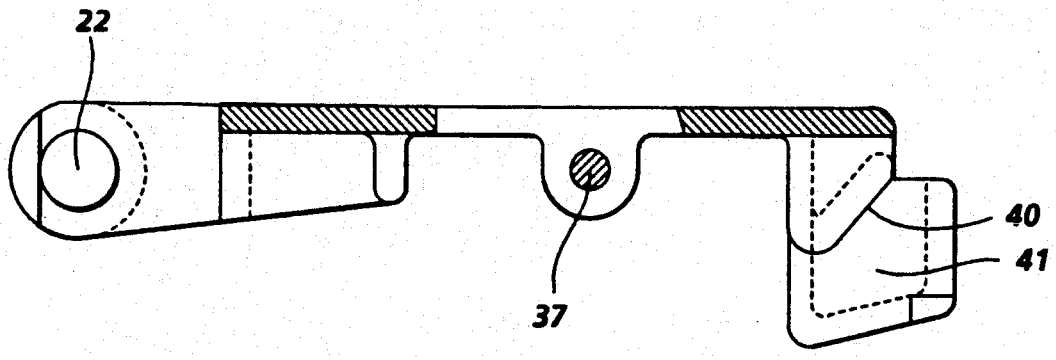
Figure 7:
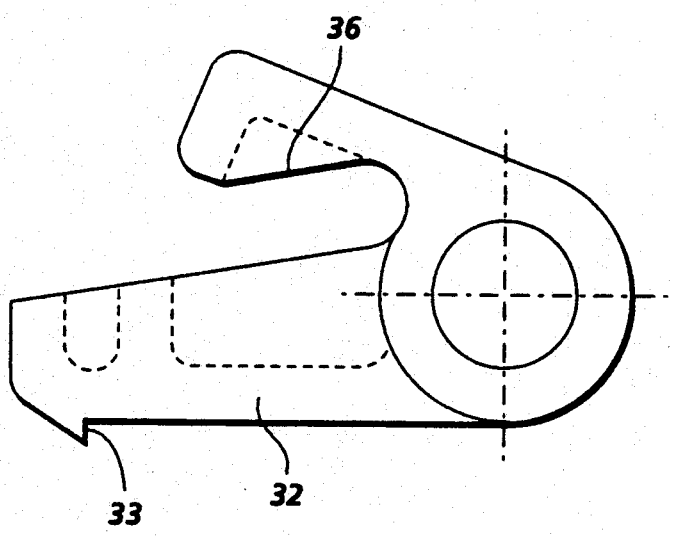
FIG. 7 is a cross sectional view of a bypass registration figure.

As illustrated in FIGS. 3 and 4, the feed rolls 17 are rotatable through openings 42 in the bypass guide 31 from a nonfeeding standby position where the segmented portion 27 is on the side of the shaft 26 opposite the sheet support platform 11 and a sheet feeding position where the segmented feed portion 27 is between the shaft 26 and the sheet support platform 11. As the feed roll 17 is rotated clockwise, the cam surface 28 on the feed roll engages the surface on the bottom of the bypass guide 1 adjacent the feed roll to pivot the bypass guide 31 upwardly. At the same time, the pins 32 on the bypass guide 31 engage the cam surface 36 on the bypass registration finger 32 to move the registration finger out of the sheet feeding path.

The operation of the sheet feeder is the same in both the normal feeding of sheets from a stack of sheets on the sheet support platform and in the feeding of a single sheet through the bypass operation. In both operations a sheet is fed through a sheet feeding path defined by the segmented feed portion of the feed roll and the top sheet in a stack of sheets on the sheet support platform. Downstream of the feed roll the guide chute members and registration roll pair further define the sheet feeding path. In the bypass operation with the feed roll in the standby position a sheet is inserted through a manual bypass passage 45 in a cover 46 on the outside of the printing machine onto the top of the stack of sheets on the sheet support platform until it's lead edge comes into contact with the tips 33 on the end of the bypass registration fingers 32. The start print button on the control console of the machine would be activated and the sheet feeder also activated at the appropriate time in the imaging cycle, wherein the feed roll would rotate clockwise, the cam surface would engage the bypass guide raising it upwardly which would also raise the control pins on the bypass guide in engagement with the cam surface on the bypass registration finger raising it out of the sheet feeding path and the segmented portion of the feed roll would advance the bypass sheet into the stalled roll registration system. The same action takes place in the feeding of a nonbypass sheet from the stack of sheets on the sheet support platform. In the bypass mode when feeding the sheet, the feed roll depresses the stack against the spring so that the snubbers are depressed below the level of the bypass sheet as the bypass sheet is fed and therefore, they do not interfere with the bypass sheet feeding.

Figure 8:
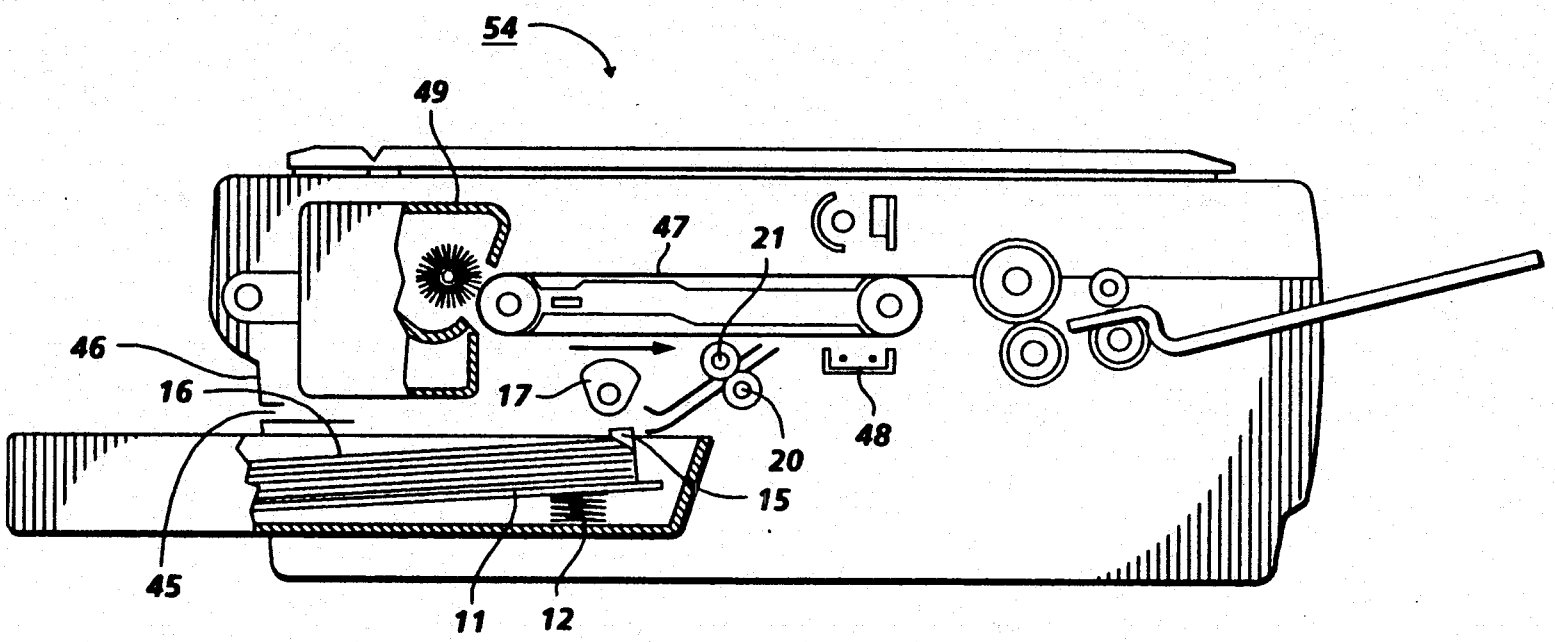
FIG. 8 is a schematic representation in cross section of an automatic electrostatographic printing machine and with sheet feeder and single sheet bypass, according to the present invention.

Turning now to FIG. 8 an automatic printing machine 54 is illustrated which is adapted to operate in a two cycle fashion in that the photoreceptor belt is charged, exposed and the resulting electrostatic latent image developed on the first cycle of the belt while the developed toner image on the belt is transferred to a copy sheet as the belt begins it's second revolution through the processing stations. Thereafter, in the second cycle of operation the belt is cleaned of residual toner by the developer station in preparation for producing the next copy. With this two-cycle geometry a combined charging/transfer unit and a combined developer/cleaning unit are used. The printing machine has a sheet feeder according to the present invention and a passage 45 in cover 46 for manually bypassing the stack and inserting a bypass sheet to the sheet feeder and in particular to the bypass registration fingers. For further details of the electrostatographic printing apparatus illustrated in FIG. 8, attention is directed to U.S. Pat. No. 4,556,308 to Hoppner et al., which is hereby incorporated in it's entirety by reference into this application.

Thus, according to the present invention, a simple, low cost, simple sheet feeder with single sheet bypass capability has been provided. In particular, the bypass capability does not require an additional drive mechanism, is totally mechanical and does not require customer adjustments. The elements providing the bypass capability are further readily adaptable to many existing sheet feeders.

The disclosures of the patents referred to herein are hereby specifically and totally incorporated herein by reference.

While the invention has been described with reference to specific embodiments, it will be apparent to those skilled in the art that many alternatives, modifications, verifications and variations may be made. Accordingly, it is intended to embrace all such alternatives and modifications as may fall within the spirit and scope of the appended claims.

We claim:

1. A sheet feeder with single sheet bypass sheet feeding capability comprising a sheet support platform for supporting a stack of sheets, at least one sheet feed roll fixedly mounted on a rotatable shaft and having a segmented feed portion for contacting and feeding the top sheet in a stack of sheets and defining therewith a sheet feeding path, sheet registration means downstream of said feed roll, at least one sheet bypass registration finger upstream of said registration means and downstream of and freely mounted about said feed roll shaft in said sheet feeding path, a sheet bypass guide rotatably mounted about said sheet registration means, said bypass guide having an angled sheet entrance throat to center a sheet and guide the leading edge into said bypass registration fingers, said feed roll being rotatable through an opening in said bypass guide from a nonfeeding, standby position said segmented portion is on the side of said shaft opposite said sheet support platform and a sheet feeding position where said segmented portion is between said shaft and said sheet support platform, said feed roll including means to move said bypass registration finger out of said sheet feeding path.

2. The sheet feeder of claim 1 wherein said means to move includes a cam surface on said feed roll engagable with said bypass guide to pivot said sheet entrance throat upwardly, said bypass guide including at least one pin engagable with a cam surface on said bypass finger to move said bypass registration finger out of said sheet feeding path.

3. The sheet feeder of claim 1 wherein said sheet support platform is urged upwardly toward said sheet feed roll.

4. The sheet feeder of claim 3 wherein said bypass registration fingers in the standby position rest on top of a stack of sheets when a stack of sheets is on the sheet support platform.

5. The sheet feeder of claim 3 further including two corner snubbers to engage the corners of the leading edge of a stack of sheets.

6. The sheet feeder of claim 1 wherein said sheet registration means includes a driven roll and an idler roll forming a stalled roll registration system.

7. The sheet feeder of claim 1 wherein the angled sheet entrance guide has angled guide planes to both vertically and horizontal locate the leading edge of a bypass sheet.

8. The sheet feeder of claim 1 wherein said sheet support platform is in a cassette.

9. An automatic printing machine comprising means to print images on sheets and including a sheet feeder for feeding sheets from a stack of sheets and a passage for manually bypassing said stack of sheets and inserting a sheet to said sheet feeder, said sheet feeder comprising a sheet support platform for supporting a stack of sheets, at least one feed roll fixedly mounted on a rotatable shaft and having a segmented feed portion for contacting and feeding the top sheet in a stack of sheets and defining therewith a sheet feeding path, sheet registration means downstream of said feed roll, at least one sheet bypass registration finger upstream of said registration means and downstream of and freely mounted about said feed roll shaft in said sheet feeding path, a sheet bypass guide rotatably mounted about said sheet registration means, said bypass guide having an angled sheet entrance throat to center a sheet and guide the leading edge into said bypass registration fingers, said feed roll being rotatable through an opening in said bypass guide from a nonfeeding, standby position where said segmented portion is on the side of said shaft opposite said sheet support platform and a sheet feeding position where said segmented portion is between said shaft and said sheet support platform, said feed roll including means to move said bypass registration finger out of said sheet feeding path.

10. The printing machine of claim 9 wherein said means to move includes a cam surface on said feed roll engagable with said bypass guide to pivot said sheet entrance throat upwardly, said bypass guide including at least one pin engagable with a cam surface on said bypass finger to move said bypass registration finger out of said sheet feeding path.

11. The printing machine of claim 9 wherein said sheet support platform is urged upwardly toward said sheet feed roll.

12. The printing machine of claim 11 wherein said bypass registration fingers in the standby position rest on top of a stack of sheets when a stack of sheets in on the sheet support platform.

13. The printing machine of claim 11 further including two corner snubbers to engage the corners of the leading edge of a stack of sheets.

14. The printing machine of claim 9 wherein said sheet registration means includes a driven roll and an idler forming a stalled roll registration system.

15. The printing machine of claim 9 wherein the angled sheet entrance guide has angled guide planes to both vertically and horizontal locate the leading edge of a bypass sheet.

16. The printing machine of claim 9 wherein said sheet support platform is in a cassette.

* * * * *